United States Patent [19]

Thomas et al.

[11] Patent Number: 4,759,191

[45] Date of Patent: Jul. 26, 1988

[54] MINIATURIZED COOLING DEVICE AND METHOD OF USE

[75] Inventors: Dennis A. Thomas, Los Angeles; Cullen M. Sabin, Solana Beach; John H. Cover, Newport Beach, all of Calif.

[73] Assignee: Liquid $CO_2$ Engineering, Inc., Los Angeles, Calif.

[21] Appl. No.: 70,973

[22] Filed: Jul. 7, 1987

[51] Int. Cl.[4] ..... F25B 17/08

[52] U.S. Cl. ..... 62/101; 62/480; 62/337

[58] Field of Search ..... 62/480, 477, 476, 235.1, 62/502, 294, 48, 457, 101, 337; 237/213

[56] References Cited

U.S. PATENT DOCUMENTS

| | | | |
|---|---|---|---|
| 2,144,441 | 1/1939 | Schlumbohm | 62/480 |
| 3,316,736 | 5/1967 | Biermann | 62/502 |
| 3,726,106 | 4/1973 | Jaeger | 62/294 |
| 3,950,960 | 4/1976 | Kawam | 62/48 |
| 3,967,465 | 7/1976 | Asselman et al. | 62/48 |
| 3,970,068 | 7/1976 | Sato | 126/263 |
| 4,126,016 | 11/1978 | Greiner | 62/457 |
| 4,250,720 | 2/1981 | Siegel | 62/480 |
| 4,682,476 | 7/1987 | Payre et al. | 62/477 |

FOREIGN PATENT DOCUMENTS 2095386 2/1982 United Kingdom .

*Primary Examiner*—Henry A. Bennet

*Attorney, Agent, or Firm*—Knobbe, Martens, Olson & Bear

[57] ABSTRACT

Disclosed is a self-contained, rapid cooling device that retains heat produced from the cooling process and can be stored for indefinite periods without loosing its cooling potential. A liquid in a first chamber undergoes a change of phase into vapor, which cools the first chamber. A sorbent in a second chamber is in fluid communication with the vapor and removes the vapor from the first chamber. The cooling process is facilitated by lining the interior surface of the first chamber with a wicking material to retain the largest possible contact between the liquid and the first chamber as the level of the liquid lowers during the vaporization process. A phase separator prevents unvaporized liquid from passing into the second chamber. The device is self-contained because a material in contact with the sorbent removes the heat from the sorbent to prevent the reduction in the cooling effect produced by the first chamber.

32 Claims, 1 Drawing Sheet

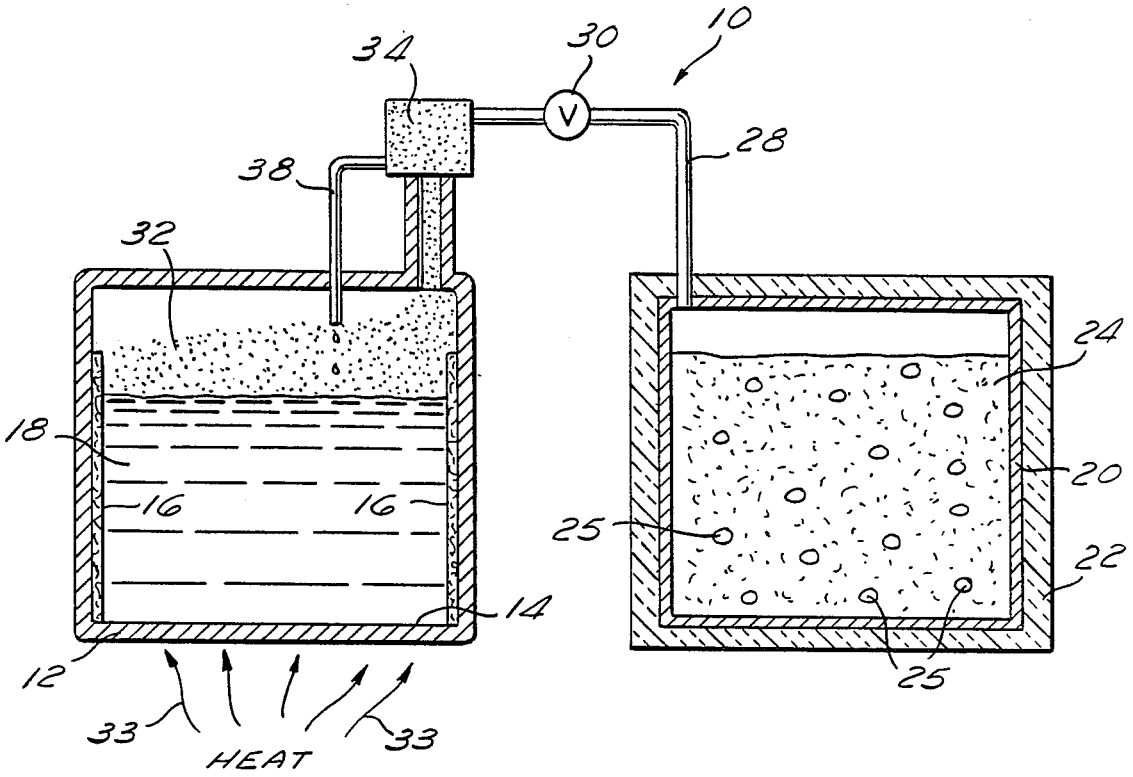
10
30
V
34
28
38
32
24
18
20
16
16
25
22
14
12
25
33
HEAT
33

MINIATURIZED COOLING DEVICE AND METHOD OF USE

BACKGROUND OF THE INVENTION

The invention relates to temperature changing devices and in particular to portable or disposable food or beverage coolers.

There are many foods and beverages that may be stored almost indefinitely at average ambient temperature of 20°–25° C., but that should be cooled immediately before consumption. In general, the cooling of these foods and beverages is accomplished by electrically-run refrigeration units. The use of these units to cool such foods and beverages is not always practical, because refrigerators generally require a source of electricity, they are not usually portable, and they do not cool the food or beverage quickly.

An alternate method for providing a cooled material on demand is to use portable insulated containers. However, these containers function merely to maintain the previous temperature of the food or beverage placed inside them, or they require the use of ice cubes to provide the desired cooling effect. When used in conjunction with ice, insulated containers are much more bulky and heavy than the food or beverage. Moreover, in many locations, ice may not be readily available when the cooling action is required.

Ice cubes have also been used independently to cool food or beverages rapidly. However, utilization of ice independently for cooling is often undesirable, because ice may be stored only for limited periods above 0° C. Moreover, ice may not be available when the cooling action is desired.

In addition to food and beverage cooling, there are a number of other applications for which a portable cooling device is extremely desirable. These include medical applications, including cooling of tissues or organs, preparation of cold compresses and cryogenic destruction of tissues as part of surgical procedures; industrial applications, including production of cold water or other liquids upon demand; preservation of biological specimens; cooling of protective clothing; and cosmetic applications. A portable cooling apparatus could have widespread utility in all these areas.

Most attempts to build a self-contained miniaturized cooling device have depended on the use of a refrigerant liquid stored at a pressure above atmospheric pressure, so that the refrigerant vapor could be released directly to the atmosphere. Unfortunately, many available refrigerant liquids for such a system are either flammable, toxic, harmful to the environment, or exist in liquid form at such high pressures that they represent an explosion hazard in quantities suitable for the intended purpose. Conversely, other available refrigerant liquids acceptable for discharge into the atmosphere (such as carbon dioxide) have relatively low heat capacities and latent heats of vaporization. As a result, some cooling devices which release carbon dioxide are more bulky than is commercially acceptable for a portable device.

An alternate procedure for providing a cooling effect in a portable device is to absorb or adsorb the refrigerant vapor in a chamber separate from the chamber in which the evaporation takes place. In such a system, the refrigerant liquid boils under reduced pressure in a sealed chamber and absorbs heat from its surroundings. The vapor generated from the boiling liquid is continuously removed from the first chamber and discharged into a second chamber containing a dessicant or sorbent that absorbs the vapor.

The use of two chambers to produce a cooling effect around one chamber is illustrated in U.S. Pat. No. 4,250,720 to Siegel and Great Britain Pat. No. 2,095,386 to Cleghorn, et al. These patents disclose a two-chamber apparatus connected by a tube. The Siegel patent uses water as the refrigerant liquid, while the Cleghorn, et al. patent is not limited to water. The Siegel patent envisions the use of such a cooling device to cool food or beverages. However, both systems produce heat in the absorption chamber, and the chamber must be distanced from the area cooled by the first chamber so that the cooling effect is not compromised.

Furthermore, in both the Siegel and Cleghorn, et al. patents, the rapid initial cooling effect gradually slows as a result of both the decrease in temperature of the object to be cooled and decrease in the heat transfer area of the first chamber. The decrease in heat transfer area is due to the fact that the portion of the first chamber in contact with the liquid decreases as the liquid vaporizes and the liquid level drops. None of the prior art effectively deals with the problem of heat buildup in the sorbent chamber; thus, none of the prior sorption-cooling devices are fully suitable for use in miniaturized food, beverage, and other cooling systems.

Accordingly, one objective of the present invention is to provide a self-contained sorption cooling device with a means for handling heat produced in the sorbent so that the cooling effect in the evaporation chamber is not effectively diminished. An additional objective of the present invention is to alleviate the decrease in heat transfer as the liquid vaporizes, and therefore speed the cooling process.

Other objectives will become apparent from the appended drawing and the following detailed description of the invention.

SUMMARY OF THE INVENTION

The present invention is a miniaturized cooling device, comprising a first chamber containing a liquid which preferably has a vapor pressure at 20° C. of at least about 9 mm Hg, a second chamber containing a sorbent for the liquid and a material for removing heat from the sorbent, a conduit connecting the first and second chambers, a valve in the conduit for preventing flow through the conduit between the chambers, and means for opening the valve. The heat removing material comprises a phase change material, a thermal mass different from the material comprising the second chamber in contact with the sorbent having a heat capacity greater than the heat capacity of the sorbent, or a material that undergoes an endothermic reaction when brought into contact with the liquid. The second chamber is initially evacuated. Thus, when the valve is opened, the first and second chambers are connected and fluid communication between them is possible. This causes a drop in pressure in the first chamber because the second chamber is evacuated. The drop in pressure causes the liquid in the first chamber to vaporize, and because this liquid-to-gas phase change can occur only if the liquid removes heat equal to the latent heat of vaporization of the evaporated liquid from the first chamber, the first chamber cools. The vapor passes through the conduit and into the second chamber where it is absorbed or adsorbed by the sorbent. The sorbent also absorbs all of the heat contained in the absorbed or adsorbed vapor, and if the absorption-adsorption process involves a chamical reaction, then the sorbent must also absorb the reaction heat. The heat removing material then removes the heat from the sorbent to prevent the second chamber from heating and compromising the cooling effect produced by the first chamber.

In a preferred embodiment, the liquid is water, and the first chamber's interior surface may be lined with a wicking material for the liquid.

In one embodiment of the invention, the liquid is mixed with a nucleating agent that promotes ebullition of the liquid. A phase separator for preventing unvaporized liquid from the first chamber from passing through the conduit into the second chamber may advantageously be included in the device. The sorbent material may be an adsorbent or absorbent, and the second chamber preferably contains sufficient sorbent to absorb or adsorb substantially all of the liquid in the first chamber. The entire device is preferably disposable.

In use, the vaporization process causes the level of the liquid in the first chamber to drop, but in the preferred embodiment, the wicking material retains the liquid on the interior surface of the first chamber. This maintains a substantial area of contact between the liquid and the interior surface of the first chamber to avoid a reduction in the effective heat transfer area of the first chamber and a resultant slowing of the cooling process.

The present invention provides a self-contained rapid cooling device that cools a food, beverage, or other material or article from ambient temperature on demand in a timely manner, exhibits a useful change in temperature, retains the heat produced from the cooling process or retards the transfer of heat from the sorbent back to the material being cooled, can be stored for unlimited periods without losing its cooling potential, and is able to meet government standards for safety in human uses.

BRIEF DESCRIPTION OF THE DRAWING

The FIGURE is a schematic representation of a cooling device according to the present invention.

DETAILED DESCRIPTION OF THE INVENTION

In FIG. 1, the cooling device 10 has a first chamber 12 lined on the interior surface 14 with a wicking material 16, which in a preferred embodiment could be accomplished by flocking the interior surface 14 with the wicking material 16, and the first chamber 12 is filled with a refrigerant liquid 18. The cooling device 10 also includes a second chamber 20 surrounded by a thermal insulator 22 which is at least partially filled with a sorbent 24 in contact with a heat removing material 25. The second chamber 20 is initially evacuated, and the first chamber may also advantageously be evacuated to the extent that it contains only the vapor of the refrigerant liquid.

Connecting the first and second chambers 12 and 20 is a conduit 28 and a valve 30 interposed in the conduit 28, allowing fluid communication between the chambers 12 and 20 through the conduit 28 only when the valve 30 is open.

The operation of the cooling device 10 is suspended (i.e., the system is static and no cooling occurs) until the valve 30 is opened, at which time the conduit 28 provides fluid communication between the first and second chambers 12 and 20. Opening the valve 30 between the first and second chambers 12 and 20 causes a drop in pressure in chamber 12 because the second chamber 20 is evacuated. The drop in pressure in the first chamber 12 upon opening of the valve 30 causes the liquid 18 to boil at ambient temperature into a liquid-vapor mixture 32. This liquid-to-gas phase change can occur only if the liquid 18 removes heat equal to the latent heat of vaporization of the evaporated liquid 18 from the first chamber 12. This causes the first chamber 12 to cool. The cooled first chamber 12, in turn, removes heat from its surrounding material as indicated by the arrows 33.

The liquid-vapor mixture 32 is directed through a liquid-vapor collector and separator 34 of conventional design, which separates the liquid 18 from the vapor, allowing the separated liquid 18 to return to the first chamber 12 through the liquid return line 38 and allowing the vapor to pass through the conduit 28 into the second chamber 20. Once inside the second chamber 20, the vapor is absorbed or adsorbed by the sorbent 24. This facilitates the maintenance of a reduced vapor pressure in the first chamber 12 and allows more of the liquid 18 to boil and become vapor, further reducing the temperature of chamber 12. The continuous removal of the vapor maintains the pressure in the first chamber 12 below the vapor pressure of the liquid 18, so that the liquid 18 boils and produces vapor continuously until sorbent 24 is saturated, until the liquid 18 has boiled away, or until the temperature of the liquid 18 has dropped below its boiling point.

During the vaporization process, the level of the liquid 18 in the first chamber 12 drops. The wicking material 16 retains the liquid 18 on the interior surface 14 of the first chamber 12 to prevent a reduction in the area of contact between the liquid 18 and the interior surface 14, which would cause a reduction in the effective heat transfer surface area of the first chamber 12 and would thus slow the cooling process.

When the sorbent 24 absorbs or adsorbs the vapor, a heat of absorption or adsorption is generated. The heat removing material 25 which is thermally coupled to the sorbent 24 (and preferably is mixed with the sorbent 24) removes heat from the sorbent 24, preventing or slowing a rise in temperature in both sorbent 24 and chamber 20, which rise in temperature might compromise the cooling effect produced by chamber 12.

Three important components of the present invention are the evaporating liquid, the sorbent, and the heat removing material. The liquid and the sorbent must be complimentary (i.e., the sorbent must be capable of absorbing or adsorbing the vapor produced by the liquid), and suitable choices for all three of these components would be any combination able to make a useful change in temperature in a short time, meet government standards for safety, and be compact.

The refrigerant liquids used in the present invention preferably have a high vapor pressure at ambient temperature, so that a reduction of pressure will produce a high vapor production rate. The vapor pressure of the liquid at 20° C. is preferably at least about 9 mm Hg, and more preferably is at least about 15 or 20 mm Hg. Moreover, for some applications (such as cooling of food products) the liquid should conform to applicable government standards in case any discharge into the surroundings, accidental or otherwise, occurs. Liquids with suitable characteristics for various uses of the invention include various alcohols, such as methyl alcohol and ethyl alcohol; ketones or aldehydes, such as acetone and acetaldehyde; water; freons, such as freon C318, 114, 21, 11, 114B2, 113, and 112; acetone dimethyl ketal; chlorocarbon compounds, such as allyl chloride, ethyl chloride, ethylene chloride, methylene chloride, boron trichloride, and methyl chloride; ammonia; carbondisulfide; and hydrogen sulfide; and other hydrocarbon compounds, such as isoprene, carbon suboxide, butane, and cyclobutene.

In addition, the refrigerant liquid may be mixed with an effective quantity of a miscible nucleating agent having a greater vapor pressure than the liquid to promote ebullition so that the liquid evaporates even more quickly and smoothly, and so that supercooling of the liquid does not occur. Suitable nucleating agents include ethyl alcohol, acetone, methyl alcohol, propyl alcohol, and isobutyl alcohol, all of which are miscible with water. For example, a combination of a nucleating agent with a compatible liquid might be a combination of 5% ethyl alcohol in water, or 5% acetone in methyl alcohol. The nucleating agent preferably has a vapor pressure at 25° C. of at least about 25 mm Hg, and more preferably at least about 35 mm Hg. Alternatively, solid nucleating agents may be used, such as the conventional boiling stones used in chemical laboratory applications.

The sorbent material used in the second chamber 20 is preferably capable of absorbing or adsorbing all the vapor produced by the liquid, and also preferably will meet government safety standards for use in an environment where contact with food may occur. Suitable sorbents for various applications may include barium oxide, magnesium perchlorate, calcium sulfate, calcium oxide, activated carbon, calcium chloride, glycerine, silica gel, alumina gel, calcium hydride, phosphoric anhydride, phosphoric acid, potassium hydroxide, sulphuric acid, lithium chloride, ethylene glycol, and sodium sulfate.

The heat removing material may be one of three types: (1) a material that undergoes a change of phase when heat is applied; (2) a material that has a heat capacity greater than the sorbent; or (3) a material that undergoes an endothermic reaction when brought in contact with the liquid refrigerant.

Suitable phase change materials for particular applications may be selected from paraffin, naphthalene, sulphur, hydrated calcium chloride, bromocamphor, cetyl alcohol, cyanimide, eleudic acid, lauric acid, hydrated sodium silicate, sodium thiosulfate pentahydrate, disodium phosphate, hydrated sodium carbonate, hydrated calcium nitrate, Glauber's salt, potassium, sodium, and magnesium acetate. The phase change materials remove some of the heat from the sorbent material simply through storage of sensible heat. In other words, they heat up as the sorbent heats up, removing heat from the sorbent. However, the most effective function of the phase change material is in the phase change itself. An extremely large quantity of heat can be absorbed by a suitable phase change material in connection with the phase change (i.e., change from a solid phase to a liquid phase or change from a liquid phase to a vapor phase). There is typically no change in the temperature of the phase change material during the phase change, despite the relatively substantial amount of heat required to effect the change, which heat is absorbed during the change. Phase change materials which change from a solid to a liquid, absorbing from the sorbent their latent heat of fusion, are the most practical in a closed system. However, a phase change material changing from a liquid to a vapor is also feasible. Thus, an environmentally-safe liquid could be provided in a separate container (not shown) in contact with the sorbent material (to absorb heat therefrom) but vented in such a way that the boiling phase change material carries heat away from the sorbent material and entirely out of the system.

Another requirement of any of the phase change materials is that they change phase at a temperature greater than the expected ambient temperature of the material to be cooled, but less than the temperature achieved by the sorbent material upon absorption of a substantial fraction (i.e., one third or one quarter) of the refrigerant liquid. Thus, for example, in most devices according to the present invention which are intended for use in cooling a material such as a food or beverage, the phase change material could change phase at a temperature above about 30° C., preferably above about 35° C., but preferably below about 70° C., and most preferably below about 60° C. Of course, in some applications, substantially higher or lower phase change temperatures may be desirable. Indeed, many phase change materials with phase change temperatures as high as 90° C., 100° C., or 110° C. may be appropriate in certain systems.

Materials that have a heat capacity greater than that of the sorbent simply provide a thermal mass in contact with the sorbent that does not effect the total amount of heat in the system, but reduces the temperature differential between the material being cooled and the second chamber 20, with two results. First, the higher the temperature gradient between two adjacent materials, the more rapid the rate of heat exchange between those two materials, all else being equal. Thus, such thermal mass materials in the second chamber 20 slow the transfer of heat out of the second chamber 20. Second, many sorbent materials function poorly or do not function at all when the temperature of those materials exceeds a certain limit. Heat absorbing material in the form of a thermal mass can substantially reduce the rate of the sorbent's temperature increase during the cooling cycle. This, in turn, maintains the sorbent at a lower temperature and facilitates the vapor-sorption capabilities of the sorbent. Various materials which have a high specific heat include cyanimide, ethyl alcohol, ethyl ether, glycerol, isoamyl alcohol, isobutyl alcohol, lithium hydride, methyl alcohol, sodium acetate, water, ethylene glycol, and paraffin wax.

Care must be taken, of course, when selecting a high specific heat material (or high thermal mass material) to insure that it does not interfere with the functioning of the sorbent. If the heat absorbing material, for example, is a liquid, it may be necessary to package that liquid or otherwise prevent physical contact between the heat absorbing material and the sorbent. Small individual containers of heat absorbing material scattered throughout the sorbent may be utilized when the sorbent and the heat absorbing material cannot contact one another; alternatively, the heat absorbing material may be placed in a single package having a relatively high surface area in contact with the sorbent to facilitate heat transfer from the sorbent into the heat absorbing material.

The third category of heat removing material, material that undergoes an endothermic reaction, has the advantage of completely removing heat from the system and storing it in the form of a chemical change. The endothermic material may advantageously be a material that undergoes an endothermic reaction when it comes in contact with the refrigerant liquid (or vapor). In this embodiment of the invention, when the valve 30 in the conduit 28 is opened, permitting vapor to flow through the conduit 28 into the second chamber 20, the vapor comes in contact with some of the endothermic material, which then undergoes an endothermic reaction, removing heat from the sorbent 24. Such endothermic materials have the advantage that the heat is more or less permanently removed from the sorbent and little, if any of that heat can be retransferred to the material being cooled. This is in contrast to phase change materials and materials having a heat capacity greater than the sorbent material, both of which may eventually give up their stored heat to the surrounding materials, although such heat exchange (because of the insulation 22 or because of other design factors that retard heat transfer, such as poor thermal conductivity of the sorbent 24) generally does not occur with sufficient rapidity to reheat the cooled material prior to use of that material.

Heat absorbing materials which undergo an endothermic reaction may variously be selected from such compounds as $H_2BO_3$, $PbBr_2$, $KBrO_3$, $KClO_3$, $K_2Cr_2O_7$, $KClO_4$, $K_2S$, $SnI_2$, $NH_4Cl$, $KMnO_4$, and $CsClO_4$. Furthermore, the heat removing material may be advantageously in contact with the sorbent. In various embodiments of the invention, the sorbent and heat removing material could be blended, the heat removing material could be in discrete pieces mixed with the sorbent, or the material could be a mass in contact with, but not mixed into, the sorbent.

In selecting the wicking material 16, any of a number of materials may be chosen, depending upon the requirements of the system and the particular refrigerant liquid 18 being used. The wicking material may be something as simple as cloth or fabric having an affinity for the refrigerant liquid 18 and a substantial wicking ability. Thus, for example, when the refrigerant liquid is water, the wicking material may be cloth, sheets, felt, or flocking material, which may be comprised of cotton, filter material, natural cellulose, regenerated cellulose, cellulose derivatives, blotting paper, or any other suitable material.

The thermal insulator 22 may be any conventional insulation material, but is preferably an inexpensive, easily-formed material such as a low cost polystyrene foam.

The invention also includes a method of using the cooling device described herein. This method includes the step of providing a cooling device of the type set forth herein; opening the valve between the first chamber 12 and the second chamber 20, whereby the pressure in the first chamber is reduced, causing the liquid to boil, forming a vapor, which vapor is collected by the sorbent material; removing vapor from the second chamber by collecting the same in the sorbent until an equilibrium condition is reached, wherein the sorbent is substantially saturated or substantially all of the liquid originally in the first chamber has been collected in the sorbent; and simultaneously removing heat from the sorbent by means of the heat removing material described above. The process is preferably a one-shot process; thus, opening of the valve 30 in the conduit 28 connecting the first chamber 12 and the second chamber 20 is preferably irreversible. At the same time, the system is a closed system; in other words, the refrigerant liquid does not escape the system, and there is no means whereby the refrigerant liquid or the sorbent may escape either the first chamber 12 or the second chamber 20.

Although the invention has been described in the context of certain preferred embodiments, it is intended that the scope of the invention not be limited to the specific embodiment set forth herein, but instead be measured by the claims which follow.

What is claimed is:

1. A self-contained cooling apparatus, comprising:

a first chamber containing a liquid having a vapor pressure at 20° C. of above about 9 mm Hg;

a second evacuated chamber containing a sorbent for said liquid;

a conduit connecting said first and second chambers;

a valve in said conduit for preventing flow through said conduit between said chambers;

an actuator for opening said valve to connect said first and second chambers, permitting said liquid to vaporize and permitting said vapor to pass through said conduit and into said sorbent, whereby the evaporation of said liquid serves to cool said first chamber; and apparatus for substantially inhibiting the heat which is generated in said sorbent during sorption of said vapor from escaping from said self-contained apparatus, said apparatus comprising a material thermally coupled to said sorbent for removing heat from said sorbent.

2. A method for cooling, comprising the steps of:

(a) providing a cooling device comprising:

(i) a first chamber containing a liquid having a vapor pressure at 20° C. of above about 9 mm Hg.;

(ii) a second evacuated chamber containing a sorbent for said liquid;

(iii) a conduit connecting said first and said second chamber;

(iv) a valve in the conduit preventing communication between said first chamber and said second chamber while said valve is closed; and (v) means for opening said valve to connect said first and said second chamber;

(b) opening said valve to permit communication between said first chamber and said second chamber, whereby the pressure in said first chamber is reduced, causing said liquid to boil, forming a vapor, which vapor is directed through said conduit into said second chamber;

(c) removing vapor from said second chamber by collecting same in said sorbent until an equilibrium condition is reached, wherein said sorbent is substantially saturated or substantially all of the liquid originally in said first chamber has been collected in said sorbent; and (d) substantially inhibiting heat from said sorbent from escaping from said self-contained apparatus, said inhibiting step comprising:

providing, in thermal communication with said sorbent, a material for removing heat from said sorbent, and removing heat from said sorbent by means of said heat removing material while said sorbent is removing liquid vapor from said first chamber.

3. A self-contained cooling apparatus, as defined in claim 1, wherein said material thermally coupled to said sorbent comprises:

a phase change material, a thermal mass different from the material comprising said second chamber having a heat capacity greater than the heat capacity of said sorbent, or a material that undergoes an endothermic reaction when brought into contact with said liquid.

4. The apparatus of claim 1, wherein said first chamber has an interior surface lined with a wicking material for said liquid.

5. The apparatus of claim 1, further comprising a phase separator for preventing unvaporized liquid from said first chamber from passing through said conduit into said second chamber.

6. The apparatus of claim 5, wherein said heat removing material comprises a phase change material.

7. The apparatus of claim 6, wherein said phase change material is sodium acetate, paraffin, naphthalene, sulfur, hydrated calcium chloride, bromocamphor, cetyl alcohol, cyanimide, eleudic acid, lauric acid, hydrated sodium silicate, potassium, sodium, or magnesium acetate.

8. The apparatus of claim 1, wherein said liquid is water.

9. The apparatus of claim 1, wherein said sorbent is an adsorbent.

10. The apparatus of claim 1, wherein said sorbent is an absorbent.

11. The apparatus of claim 1, wherein said sorbent is a zeolite, activated alumina, barium oxide, magnesium perchlorate, calcium sulfate, calcium oxide, activated carbon, calcium chloride, glycerin, silica gel, alumina gel, calcium hydride, phosphoric anhydride, phosphoric acid, potassium hydroxide, sulfuric acid, lithium chloride, ethylene glycol, or sodium sulfate.

12. The apparatus of claim 1, wherein said second chamber contains sufficient sorbent to absorb or adsorb substantially all of the liquid in said first chamber.

13. The apparatus of claim 1, wherein said heat removing material comprises a thermal mass different from the material comprising said second chamber having a heat capacity greater than the heat capacity of said sorbent.

14. The apparatus of claim 13, wherein heat removing material is cyanimide, ethyl alcohol, ethyl ether, glycerol, isoamyl alcohol, isobutyl alcohol, lithium hydride, methyl alcohol, sodium acetate, water, ethylene glycol, or paraffin wax.

15. The apparatus of claim 1, wherein said heat removing material undergoes an endothermic reaction when brought into contact with said liquid.

16. The apparatus of claim 15, wherein said heat removing material is $H_2BO_3$, $PbBr_2$, $KBrO_3$, $KClO_3$, $K_2Cr_2O_7$, $KClO_4$, $K_2S$, $SnI_2$, $NH_4Cl$, $KMnO_4$ or $CsClO_4$.

17. The apparatus of claim 1, further comprising a nucleating material having a vapor pressure at 25° C. of above about 25 mm Hg in said first chamber to facilitate boiling of said liquid when the pressure in said first chamber drops as a result of opening said valve.

18. The apparatus of claim 17, wherein said nucleating material is ethyl alcohol, acetone, methyl alcohol, propyl alcohol or isobutyl alcohol.

19. The apparatus of claim 1, wherein said second chamber is in contact with a thermal insulator.

20. The apparatus of claim 1, wherein said apparatus is disposable.

21. A method for cooling, as defined in claim 2, wherein said step of providing a material comprises:

providing a phase change material, a thermal mass different from the material comprising said second chamber having a heat capacity greater than the heat capacity of said sorbent, or a material that undergoes an endothermic reaction when brought into contact with said liquid.

22. The method of claim 21, wherein said first chamber has an interior surface lined with a wicking material for said liquid.

23. The method of claim 21, wherein said liquid is water.

24. The method of claim 21, wherein said method comprises a one-shot process.

25. The method of claim 21, wherein said heat removing material comprises a phase change material.

26. The method of claim 21, wherein said sorbent is an adsorbent.

27. The method of claim 21, wherein said sorbent is an absorbent.

28. The method of claim 21, wherein said second chamber contains sufficient sorbent to absorb or adsorb substantially all of the liquid in said first chamber.

29. The method of claim 21, wherein said heat removing material comprises a thermal mass different from the material comprising said second chamber having a heat capacity greater than the heat capacity of said sorbent.

30. The method of claim 21, wherein said heat removing material undergoes an endothermic reaction when brought into contact with said liquid.

31. The method of claim 21, wherein said liquid contains a nucleating material having a vapor pressure at 25° C. of above about 25 mm Hg in said said first chamber to facilitate boiling of said liquid when the pressure in said first chamber drops as a result of opening said valve.

32. The method of claim 21, wherein said second chamber is in contact with a thermal insulator.

* * * * *